US010495401B1

(12) United States Patent
Helton

(10) Patent No.: US 10,495,401 B1
(45) Date of Patent: Dec. 3, 2019

(54) ORTHOTROPIC BEAM TRUSS

(71) Applicant: Justin R. Helton, Fredericksburg, VA (US)

(72) Inventor: Justin R. Helton, Fredericksburg, VA (US)

(73) Assignee: The United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 16/169,239

(22) Filed: Oct. 24, 2018

(51) Int. Cl.
*F41A 23/02* (2006.01)
*F41A 21/36* (2006.01)

(52) U.S. Cl.
CPC ..... *F41A 23/02* (2013.01); *F41A 21/36* (2013.01)

(58) Field of Classification Search
CPC . B64D 7/02; F41A 23/02; F41A 21/36; F41A 23/00
USPC ..... 89/37.12, 37.13, 37.07, 37.19, 40.02
See application file for complete search history.

(56) References Cited

U.S. PATENT DOCUMENTS 5,210,370 A * 5/1993 Mraz ..... F41A 25/00 89/37.13
6,912,945 B2 * 7/2005 Ang ..... F41A 25/20 89/37.05
8,413,569 B1 * 4/2013 Helton ..... F41A 27/26 89/37.01

* cited by examiner

*Primary Examiner* — Reginald S Tillman, Jr.
(74) *Attorney, Agent, or Firm* — Gerhard W. Thielman

(57) ABSTRACT

A truss is provided for stiffening a gun barrel on a mount. The truss includes a collet, a plurality of retainers and complementary sets of first and second beams. The collet has corresponding pluralities of corners and faces and an annulus for receiving the gun barrel. The sets of beams correspond to the plurality of retainers. Each beam has proximal and distal ends in relation to the mount. The distal ends of the first beams connect to a corner. The distal ends of the second beams connect to a face. The proximal ends of the first and second beams connect to a respective retainer.

6 Claims, 6 Drawing Sheets

ORTHOTROPIC BEAM TRUSS

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to beam truss structures. In particular, the invention relates to an orthotropic truss with high modulus to stiffen gun barrels.

A science and technology (S&T) project funded at Naval Surface Warfare Center—Dahlgren Division sought to develop a 30 mm trainable gun mount with elevation pointing angles of approximately 85°. The system is designed to rotate about the ammunition feed system, extending the distance from the point of rotation to the brace location the gun barrel to be longer than traditional applications. This leads to stiffness concerns.

SUMMARY

Conventional gun barrel stiffeners yield disadvantages addressed by various exemplary embodiments of the present invention. In particular, various exemplary embodiments provide a truss for a gun mount. The truss includes a collet, a plurality of retainers and complementary sets of first and second beams. The collet has corresponding pluralities of corners and faces and an annulus for receiving the gun barrel.

The beams correspond to the plurality of retainers. Each beam has proximal and distal ends in relation to the gun mount. The distal ends of the first beams connect to a corner. The distal ends of the second beams connect to a face. The proximal ends of the first and second beams connect to a respective retainer.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable skilled artisans to practice the invention. Other embodiments may be utilized, and logical, mechanical, and other changes may be made without departing from the spirit or scope of the present invention. Hence, the following detailed description is not to be taken in a limiting sense, and the scope of the present invention is defined only by the appended claims.

The design constraints for the 30 mm gun mount drive the weight and stiffness requirements to produce the exemplary truss. The objective of the exemplary truss is to provide a highly stiff structure for bracing a gun barrel from radial and angular movement during gun fire recoil and counter recoil. The design provides a high stiffness per weight in the brace structure. Additional weight adversely affects the dynamic response of the all up gun mount.

Figure 1:
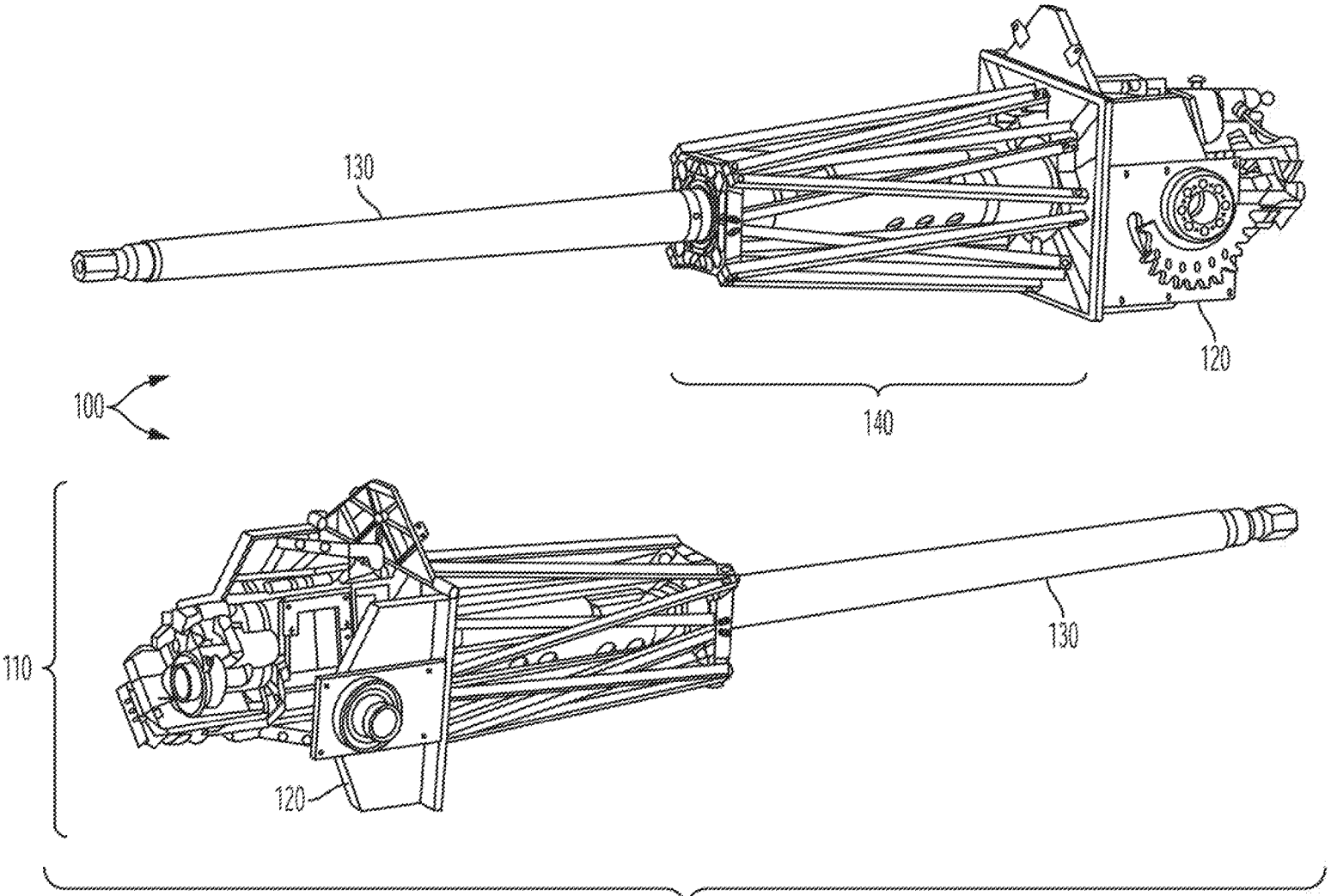
FIG. 1 is an isometric view of a gun assembly.

FIG. 1 shows isometric views 100 of an exemplary gun elevation pivot assembly 110. An alignment box 120 pivots on a mounting platform for purposes of aiming its barrel 130 in elevation towards a ballistic target. An exemplary truss 140 attaches to the alignment box 120 at its fore end to stiffen the barrel 130 against vibrations resulting from its cantilever load.

Figure 2:
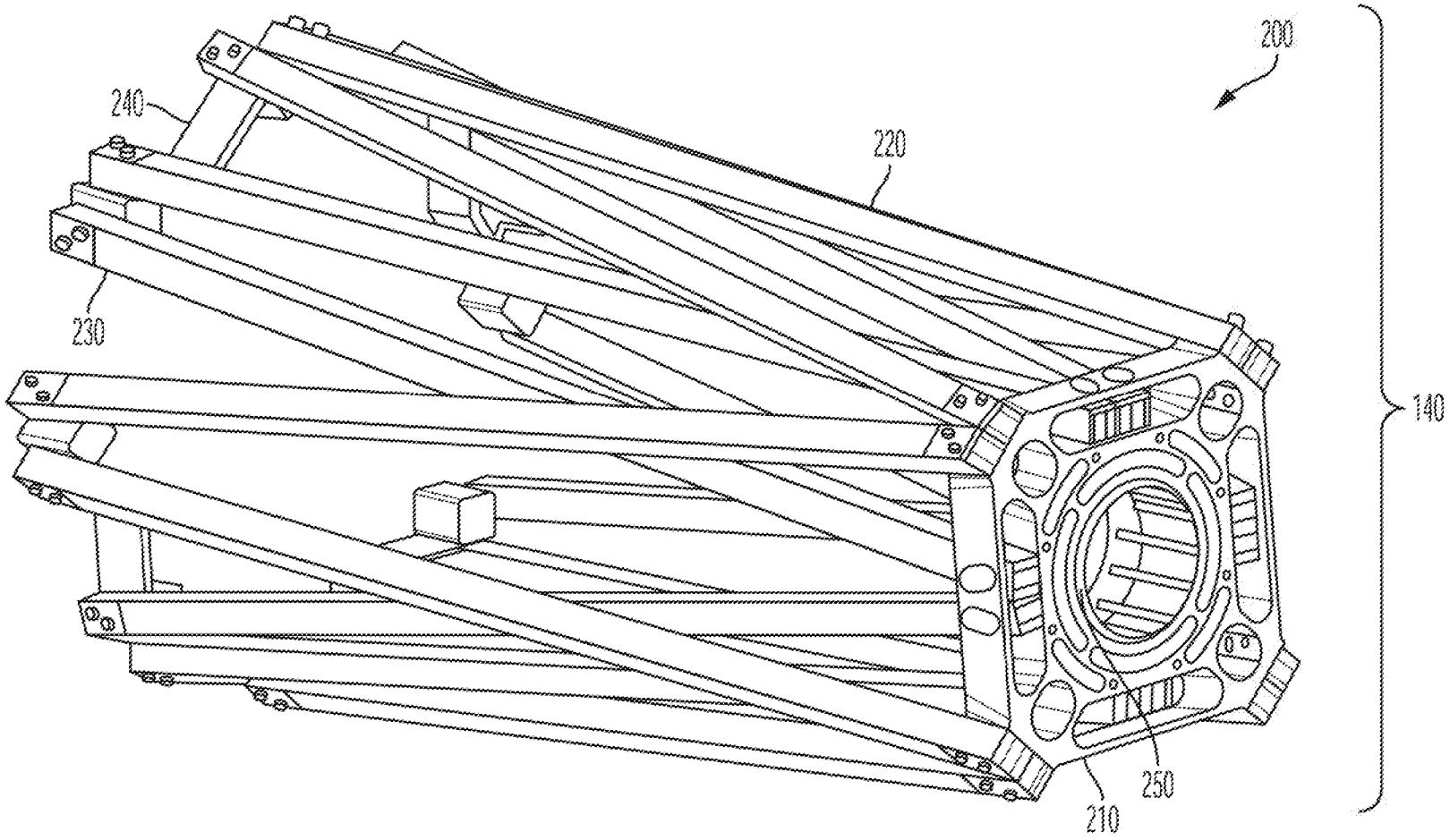
FIG. 2 is an isometric view of an exemplary truss.

FIG. 2 shows an isometric assembly view 200 of the truss 140. In relation to the view 200, this exemplary stiffening assembly includes a proximal collet 210, complementary beam sets of eight "long" beams 220 and eight "short" beams 230 that pivotably attach to the collet 210, and a distal set of four base retainers 240. An annular sleeve 250 cinches the barrel 130 in the collet 210. The two sets of eight beams 220 and 230 each are exemplary and not limiting.

The collet 210 can be composed of Inconel 625, selected to tolerate the thermal load imposed by conduction heating of the gun barrel 130 (through the sleeve 250) in response to repeated firing. Being among the least thermally conductive, commercially available metals, Inconel construction also benefits to thermally insulate the thermally vulnerable beams 220 and 230. In particular, during gun fire, the barrel temperature can exceed 1000° F., while the resin used to produce the beams 220 and 230, composed of carbon fiber, reaches glass transition phase at approximately 325° F.

The retainers 240 can comprise of aluminum alloy 6061-T6 due to its lower density than other candidate metals. The beams 220 and 230 include diagonally aligned through-holes near their proximal and distal ends (in relation to the alignment box 120). Threaded bolts pass through these holes to pivotably attach the beams 220 and 230 to the collet 210 and the retainers 240. The collet 210 includes threaded holes and the retainers 240 have helical inserts for receiving their respective bolts.

Figure 3:
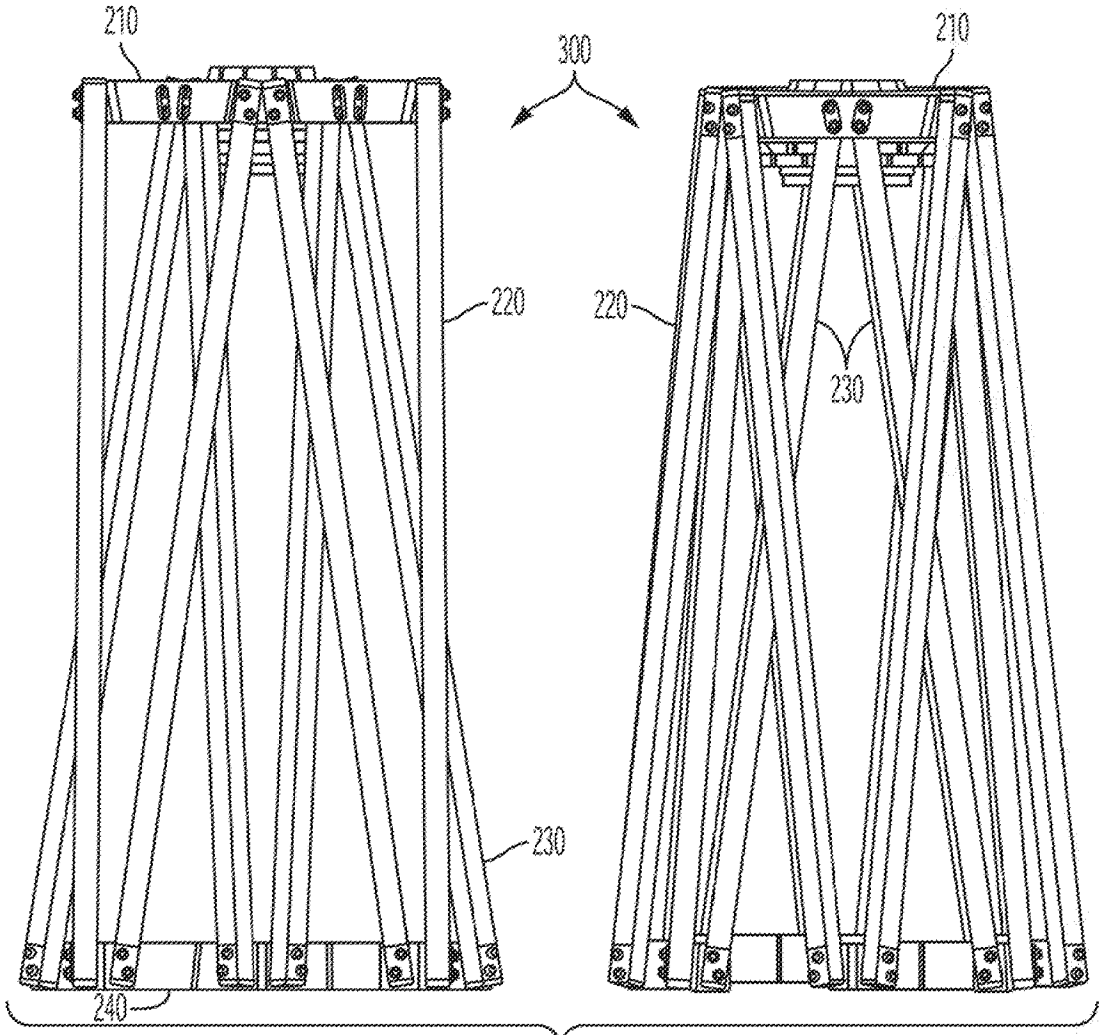
FIG. 3 is a set of elevation views of the truss.

FIG. 3 shows elevation assembly views 300 of the truss 140. Along the gun barrel 130, the beams 220 and 230 pivotably attach to the collet 210, secured by bolts at the corners for the beams 220 and the face sides for the beams 230. The beams 220 and 230 attach at opposite ends of the retainers 240 adjacent the alignment box 120 such that a retainer 240 attaches at opposite ends to beams 220 and 230. The beams 220 and 230 splay outward from the collet 210, crossing each other to splay outward from their respective retainers 240, with the corner-mount beams 220 crossing outward of the side-mount beams 230.

The beams 220 and 230 can be composed of carbon fiber to permit limited bending flexibility for the truss 140. The beams 220 and 230 can be coated to reduce fraying from abrasion. To stiffen a 30 mm (internal diameter) gun barrel 130, the beams 220 and 230 are just over three feet (36") in length and 1.0 $in^2$ in cross-section area being one inch (1.0") square on each side. A pair of diagonally aligned through-holes are disposed at each end. For the exemplary configuration, these holes are spaced laterally 0.375" and longitudinally 0.307" apart. The length difference between the longer corner-mount beams 220 and the shorter side-mount beams 230 is about ⅛" to ¼".

The beams 220 and 230 are effectively orthotropic, differing in material properties in different ortho-normal directions. The beams 220 and 230 are stiff in axial tension and compression and in lateral bending, while also compliant in lateral compression and tension as well as in axial torsion. The truss 140 ensures that at least half (eight) of the (sixteen) beams 220 and 230 are in the correct orientation to resist any load applied to the assembly 110. This also braces the other beams 230 and 220 against loads that induce stress in their compliant modes.

Figure 4B:
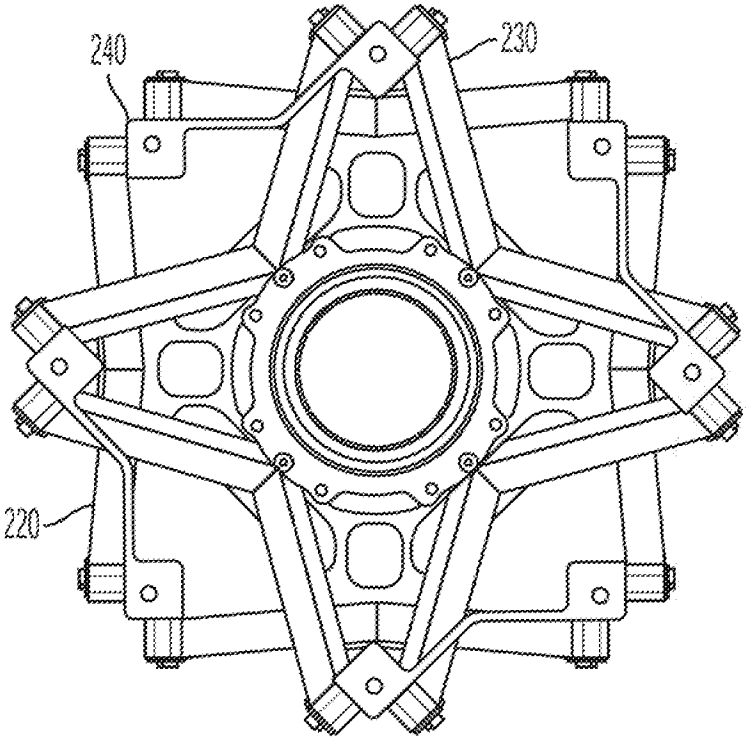
FIGS. 4A and 4B are plan views of the truss.
Figure 4A:
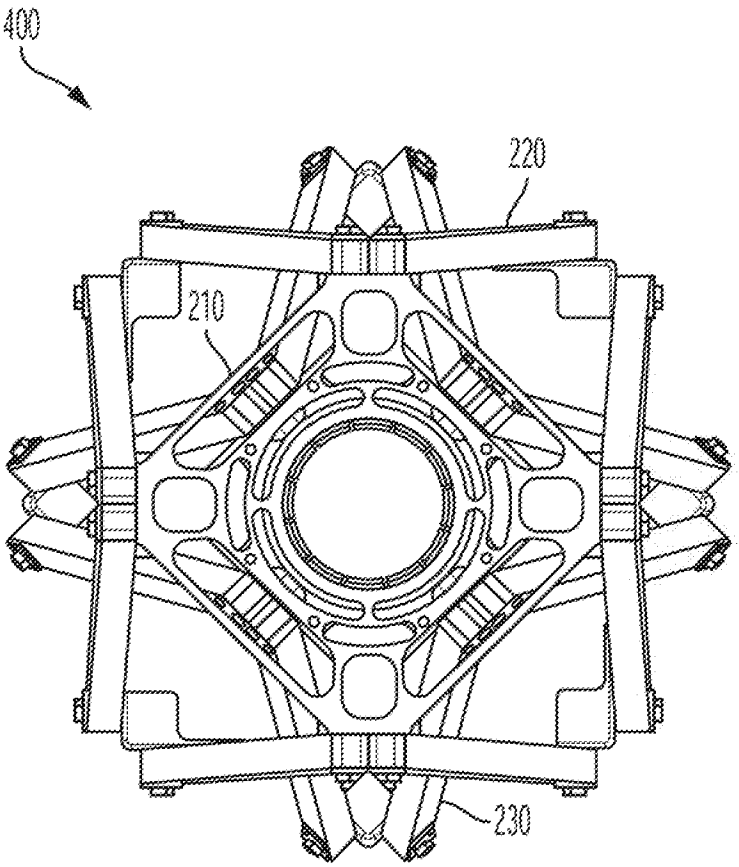

FIGS. 4A and 4B show elevation assembly views 400 of the truss 140. FIG. 4A illustrates the collet 210 viewing aft towards the alignment box 120. FIG. 4B illustrates the retainers 240 viewing forward towards the bore of the barrel 130. The corner-mount beams 220 form an approximate square pattern from the collet 210 to their respective retainers 240. By contrast, the side-mount beams 230 form a concave cruciform, extending outward from the collet 210 to their respective retainers 240. The combination of beams 220 crossing over beams 230 resembles an octagon.

Figures 5, 6:
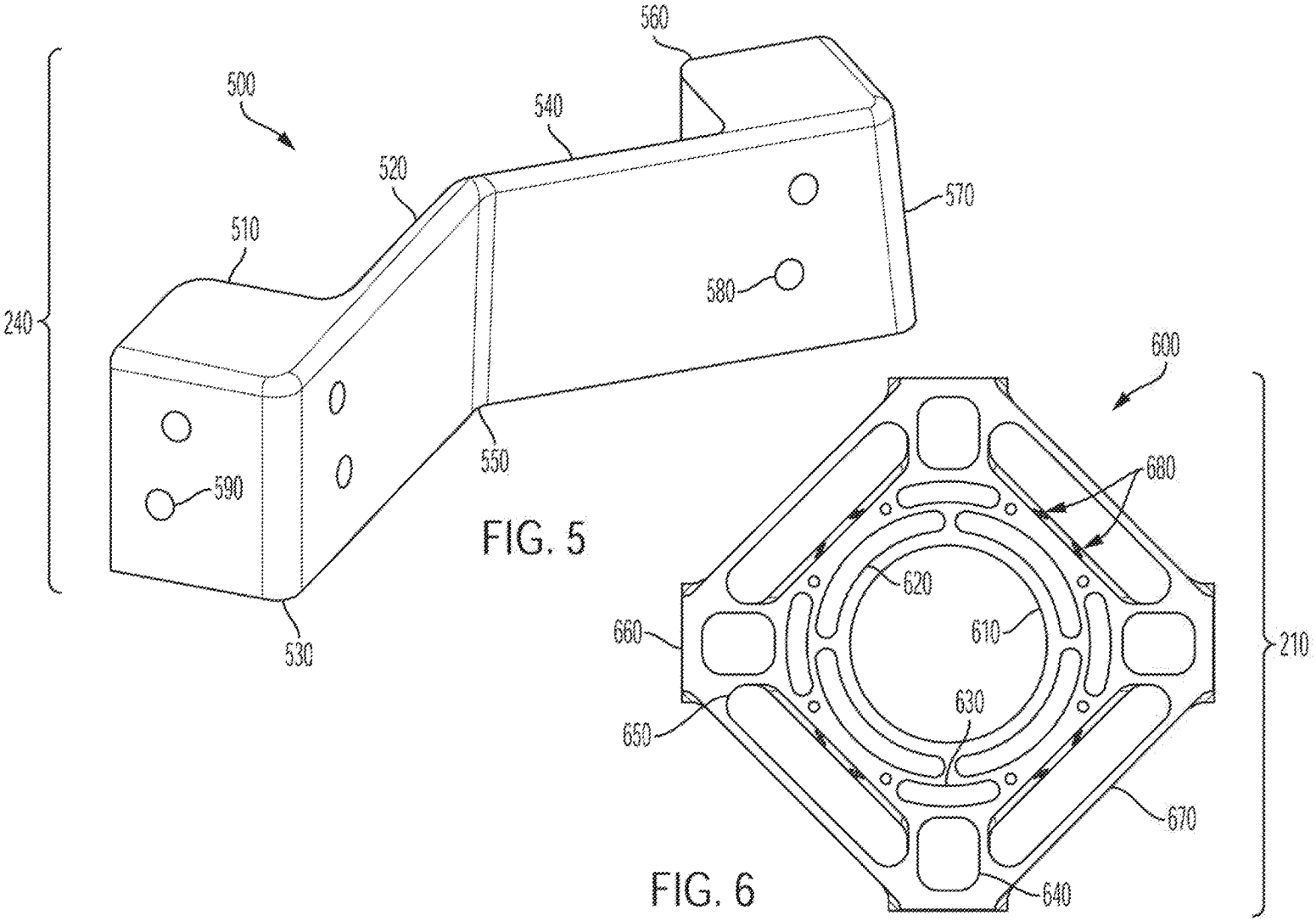
FIG. 5 is an isometric of the retainer.
FIG. 6 is a plan of the collet.

FIG. 5 shows an isometric view 500 of the retainer 240, shown as a unitary component. A proximal anchor 510 joins a proximal bridge 520, connected at a proximal joint 530. A distal bridge 540 connects to the proximal bridge 520 by an obtuse juncture 550 that forms an angle of 225° or ¾ π radians. A distal anchor 560 connects to the distal bridge 520 at a distal joint 570. The retainer 240 includes diagonally aligned pairs of threaded holes 580 and 590 at the inward and outward faces of the anchors 510 and 560.

Bolts attach the corner-mount beams 220 through the outer holes 590 to the outward faces of the proximal and distal bridges 520 and 540 in relation to view 500. Similarly, bolts attach the side-mount beams 230 through the inner holes 580 (from opposite the side shown in view 500). The outward joints 530 and 570 are canted slightly to accommodate the outward splay of the side-mount beams 230. The diagonal arrangement of the holes 580 and 590 correspond to counterpart holes near the ends of the beams 220 and 230.

FIG. 6 shows a plan view 600 of the collet 210. An upper annulus 610 accommodates the sleeve 250 for restraining the barrel 130. Four long inner arcs 620 surround the annulus 610. Four short outer arcs 630 extend radially beyond the inner arcs 620. Four corner orifices 640 extend radially beyond their corresponding outer arcs 630. Four side channels 650 extend radially beyond both sets of arks 620 and 630.

Each corner of the collet 210 exhibits a corner face 660 for receiving a pair of beams 220. Each side of the collet 210 exhibits a side face 670, at which threaded holes 680 are disposed in the respective channels 650. With a span of 10.6 inches across opposite faces 670 and accounting for cavities, the collet 210 weighs 17.4 $lb_m$, although additional metal components of 5.5 $lb_m$ facilitate to hold the barrel 130 in position.

Figure 7:
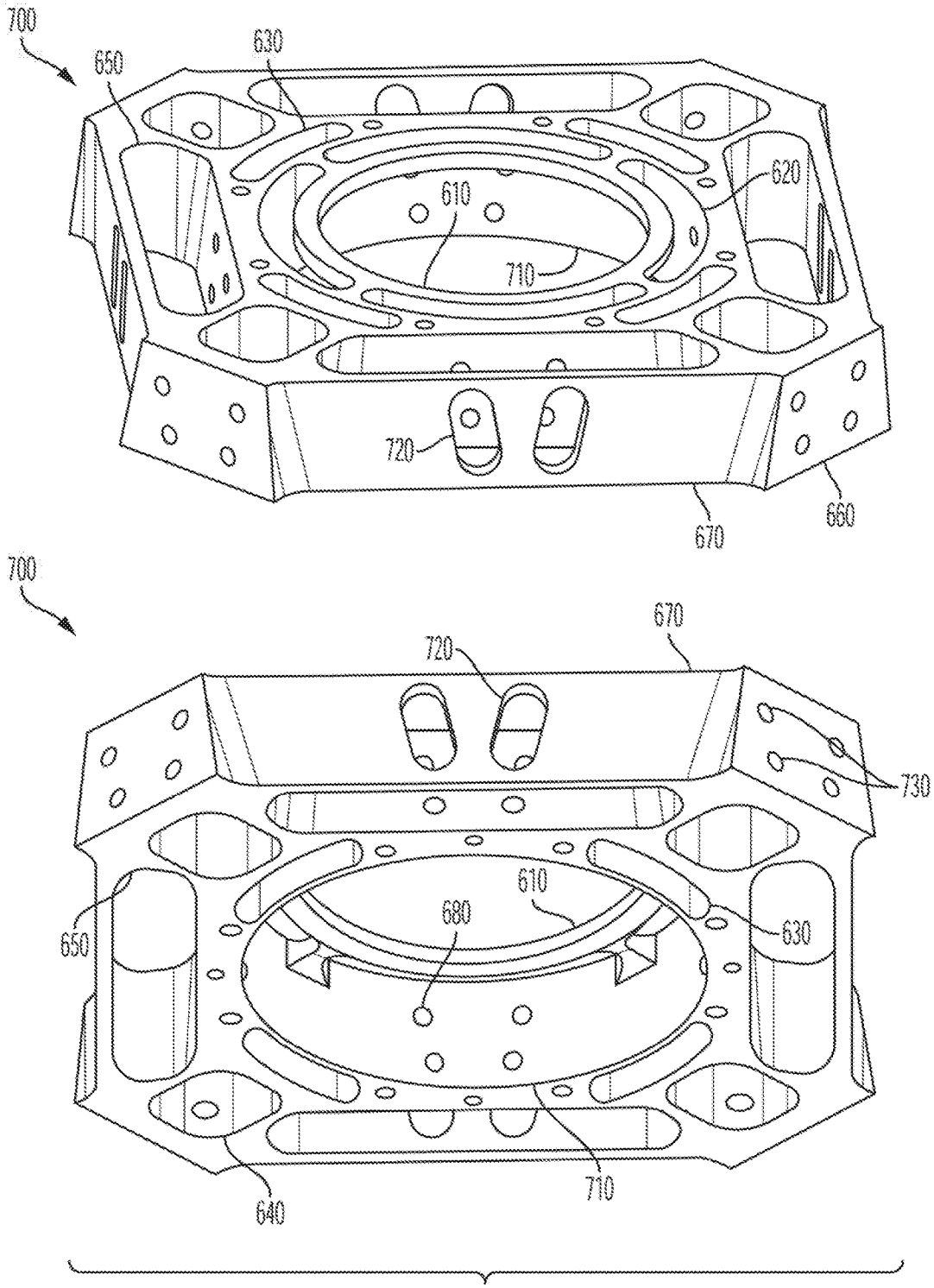
FIG. 7 is set of isometric views of the collet.

FIG. 7 shows isometric views 700 of the collet 210. The upper view illustrates the collet 210 towards aft, whereas the lower view illustrates the collet 210 towards forward. A lower annulus 710 is coaxial to the upper annulus 610 and radially extends beyond the inner arcs 620. The side faces 670 include cavities 720 for bolts that pass therethrough to secure the beams 230 at the holes 680. Bolts attach the beams 220 at the corner faces 660 inserting into threaded holes 730.

Single-direction carbon fiber beams are used in many applications and have been incorporated in truss structures, but not in the exemplary configuration. This exemplary truss 140 is useful for light weight, high stiffness bracing applications with a high natural frequency, especially in weapon pointing applications. Its principal advantage is a very high stiffness to weight ratio. As an alternative, a tub with fins and aluminum truss were analyzed, but found to be disadvantageous. For the weight, the exemplary high-modulus carbon-fiber truss configuration was approximately four times stiffer per weight than the next best solution.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A truss for stiffening a gun barrel on a mount, said truss comprising: a collet having corresponding pluralities of corners and faces and an annulus for matingly receiving the gun barrel; a plurality of retainers; complementary sets of first and second beams, each first and second beam having proximal and distal ends, said sets corresponding to said plurality of retainers, wherein each said first beam connects at said proximal end to a corner, each said second beam connects at said proximal end to a face, and each said first and second beam connects at said distal end to a corresponding retainer.

2. The mount according to claim 1, wherein each said first and second beam connects to said collet and to said corresponding retainer by a bolt fastener.

3. The mount according to claim 1, wherein each said first and second beam comprises carbon fiber.

4. The mount according to claim 1, wherein said retainers are composed of aluminum.

5. The mount according to claim 1, wherein said collet is composed of Inconel steel.

6. The mount according to claim 1, wherein said plurality of retainers and said sets of complementary beams correspond to eight in quantity.

* * * * *